US007832728B2

(12) United States Patent
Perry

(10) Patent No.: US 7,832,728 B2
(45) Date of Patent: Nov. 16, 2010

(54) DICE GAME APPARATUS

(76) Inventor: John Perry, P.O. Box 327, Highgate Center, VT (US) 05459

( * ) Notice: Subject to any disclaimer, the term of this patent is extended or adjusted under 35 U.S.C. 154(b) by 993 days.

(21) Appl. No.: 11/593,536

(22) Filed: Nov. 7, 2006

(65) Prior Publication Data

US 2008/0109211 A1 May 8, 2008

(51) Int. Cl.
*A63F 9/04* (2006.01)

(52) U.S. Cl. ..... 273/146; 273/272; 273/445; 434/172

(58) Field of Classification Search ..... 273/272, 273/146, 445; 434/172, 171
See application file for complete search history.

(56) References Cited

U.S. PATENT DOCUMENTS

| | | | | |
|---|---|---|---|---|
| 1,505,390 | A * | 8/1924 | Hamilton et al. | 273/161 |
| 1,539,895 | A * | 6/1925 | Buzza | 273/146 |
| 1,542,031 | A * | 6/1925 | Bruhn | 434/172 |
| 2,987,833 | A * | 6/1961 | Stolpen | 434/172 |
| 3,235,976 | A * | 2/1966 | Elliott et al. | 434/170 |
| 3,482,333 | A | 12/1969 | Trager, Jr. | |
| 3,670,427 | A * | 6/1972 | Stolpen | 434/157 |
| 4,044,476 | A | 8/1977 | Marsh | |
| 4,613,309 | A | 9/1986 | McCloskey | |
| 4,671,516 | A | 6/1987 | Lizzola et al. | |
| 4,684,135 | A | 8/1987 | Bouchal | |
| 5,014,996 | A | 5/1991 | von Braunhut | |
| 5,547,199 | A | 8/1996 | Calhoun | |
| 5,554,062 | A | 9/1996 | Goldsen | |
| 5,993,218 | A | 11/1999 | Kapell | |
| 6,623,009 | B1 | 9/2003 | Kraemer et al. | |
| 6,685,477 | B1 | 2/2004 | Goldman et al. | |
| 2002/0125638 | A1 | 9/2002 | Levin | |
| 2006/0197285 | A1 * | 9/2006 | McNeill | 273/292 |

FOREIGN PATENT DOCUMENTS

| | | |
|---|---|---|
| WO | WO 96/24415 | 8/1996 |

* cited by examiner

*Primary Examiner*—Benjamin H Layno
(74) *Attorney, Agent, or Firm*—John J. Welch Jr, Esq.

(57) ABSTRACT

A game of defending statements with persuasive arguments consisting of a tossing bag, a "frequency" block, two equivalent "equation" blocks; three "verb" blocks and ten "noun" blocks, a number of which are shook inside the bag, then tossed onto a table top by a so-called author who then must form and then refine a statement from the words and symbols on the face up topsides of the tossed blocks, then contrive an argument based upon the statement meant to result in the articulation of a discernible concept, challengeable however by non-author players of the game; then requiring a defense of such an argument, resulting in an awarding of playing points or not depending upon the assessment by a majority of such non-author players as to the merits of such an argument or defense whereupon one; once an author-player; then becomes a challenger-player as another player, formerly a challenger then becomes an author.

2 Claims, 15 Drawing Sheets

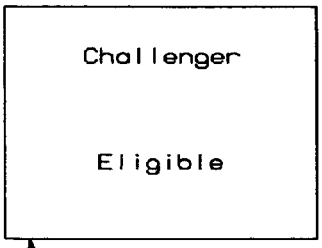
FIG. 22
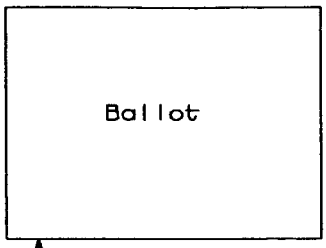
FIG. 24
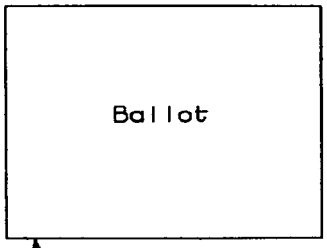
FIG. 26
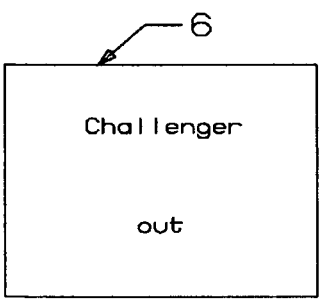
FIG. 23
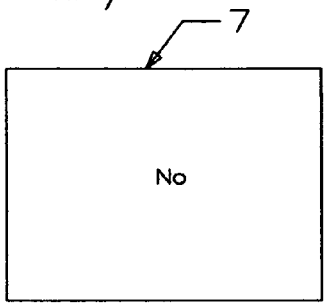
FIG. 25
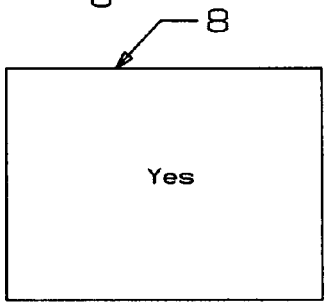
FIG. 27
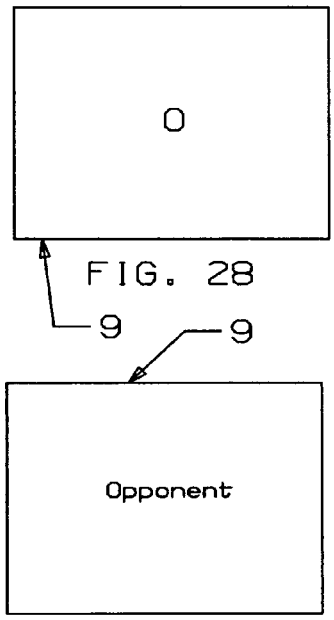
FIG. 28
FIG. 29
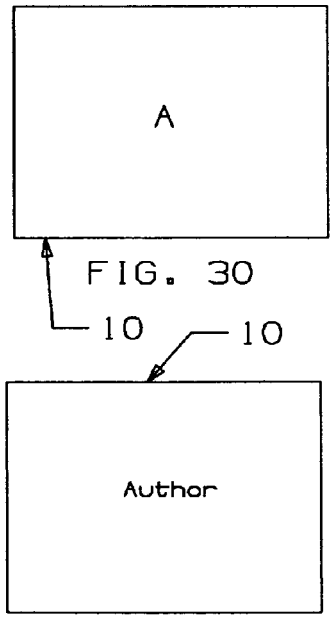
FIG. 30
FIG. 31

DICE GAME APPARATUS

CROSS REFERENCES TO PRIOR OR PARENT APPLICATIONS

There are no prior or parent applications that related to the herein described invention.

FEDERALLY SPONSORED RESEARCH AND DEVELOPMENT

There is no federally sponsored research and development relating to the herein described invention.

BACKGROUND OF THE INVENTION

1. Field of the Invention

The instant invention is a multi-player game involving a combining of words into statements amenable to defense by argument.

2. Related Art

The art depicted in and within the Art Informational Statement submitted herewith resembles but clearly does not anticipate the instant invention.

A SUMMARY OF THE INVENTION

1. A Brief Description of the Invention

The instant invention is a game playable by a plurality of persons, for instance, up to ten persons. It consists of a tossing bag containing a plurality of blocks. There are also cards to be utilized in conjunction with playing the game that are designated as author, opponent and challenge cards as well as ballot cards. There is also a timer device to be utilized in conjunction therewith as well. There is contemplated to be a notepad and pencil for keeping score as well. There are 16 blocks in all. The blocks consist of 2 equivalent equation blocks, 3 non-equivalent verb blocks, 10 non-equivalent noun blocks and one frequency block. There are 40 ballot cards. 10 of these are so-called "Yes" cards, 10 are so-called "No" cards. There are 10 designated Author cards and 10 designated Opponent cards. There is a basic game format. There is an intermediate game format and an advanced game format as well. The frequency block with an adverb depicted on each facet thereof, timer and challenge cards are intended for use within the non-basic game formats. The Author and Opponent cards are reserved for use only when playing within the advanced game format.

The basic game format consists of a rolling of the blocks by a player. Each facet of each block has a noun written on it for the noun blocks save for a so-called "wild" facet on one of these; a verb on each facet for the verb blocks save for a so-called "wild" facet on one of these and symbols for "equals", "doesn't equal", "plus", "minus", "greater or less than" and one blank so-called "wild" facet as respects the facets respectively of the equation blocks. A player designated as an author composes a statement using some or all of the words and symbols that are found face up on the rolled blocks. That player has a certain amount of time upon completion of a roll to compose such a statement literally followed by an interpretation or refining of it, then followed by a subsequent period of time within which to defend the interpretation with elaborative argument. The argument is then accepted or may be challenged by any of the other players. If challenged, the author must defend his or her argument in time limited discussion. If an argument as so defended is accepted by the other players, the arguing player, to wit, the author is then awarded points based upon the number of blocks resorted to for purposes of initially deriving the statement. The blocks are then bagged to then be rolled by the next player, now, an author, and so on through typically four rounds of play, if, for instance, it is predetermined that the game will be played in only its basic format. The intermediate game format follows the basic one except however the intermediate one provides for the issuance of challenge cards to each player serving to allow each player one challenge only per game. This format also provides for use of the frequency block as well as a debate protocol requiring the use of a timer device operated by a debate moderator selected in advance by the players from among them. The advanced format features all of the above but with the use of the Opponent and Author cards and provides for the accrual of points to a challenger.

Customarily, the game will be played with a pre-determined number of rounds in the basic format, then a predetermined number of rounds in the intermediate format and a predetermined number of rounds in the advanced format.

2. Objects of the Invention

The invention serves to provide players with a vibrantly interactive means for engaging in intellectually stimulating verbal undertakings. As such, it unquestionably constitutes what would be an extremely useful educational tool for purposes of serving any need to foster one's development of a penchant for not only creative thinking but also then creatively communicating as well. Separate and apart however from what would be its advantages as an educational tool, is the fact that the invention also affords game players with an opportunity to participate in a truly enjoyable, uniquely relaxing group experience.

A DESCRIPTION OF THE DRAWINGS

FIG. 22 is a plan view of the top side of one of a plurality of equivalent challenge card components of the instant invention.

FIG. 23 is a plan view of the bottom side of one of a plurality of equivalent challenge card components of the instant invention.

FIG. 24 is a plan view of the top side of one of a plurality of equivalent negative ballot card components of the instant invention.

FIG. 25 is a plan view of the bottom side of one of a plurality of equivalent negative ballot card components of the instant invention.

FIG. 26 is a plan view of the top side of one of a plurality of equivalent affirmative ballot card components of the instant invention.

FIG. 27 is a plan view of the bottom side of one of a plurality of equivalent affirmative ballot card components of the instant invention.

FIG. 28 is a plan view of the top side of one of a plurality of equivalent Opponent card components of the instant invention.

FIG. 29 is a plan view of the bottom side of a plurality of equivalent Opponent card components of the instant invention.

FIG. 30 is a plan view of the top side of a plurality of equivalent Author card components of the instant invention.

FIG. 31 is a plan view of the bottom side of a plurality of equivalent Author card components of the instant invention.

A DESCRIPTION OF THE PREFERRED EMBODIMENT

Figure 1:
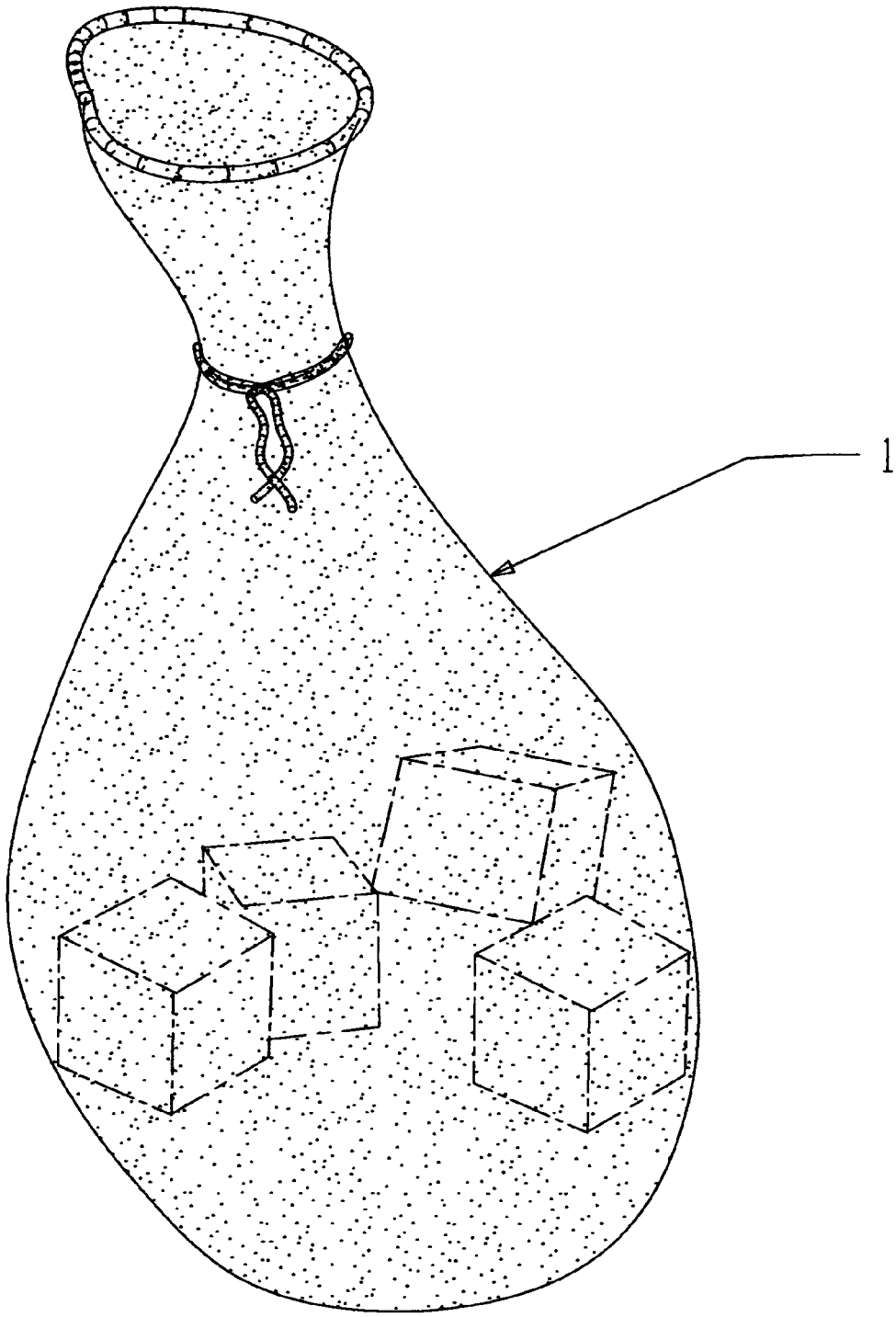
FIG. 1 is a plan view of the tossing bag component of the instant invention.
Figure 4:
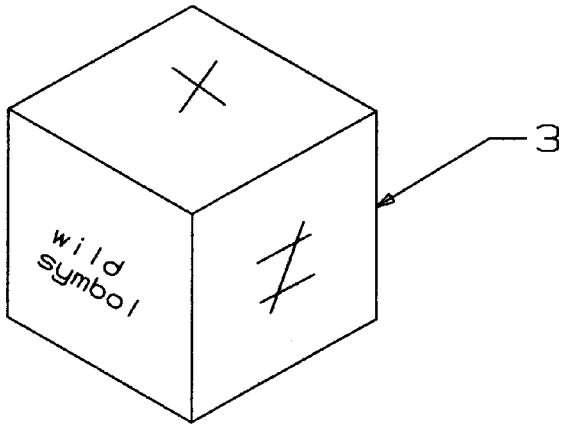
FIG. 4 is a perspective view of one of the two equivalent equation block components of the instant invention.
Figure 5:
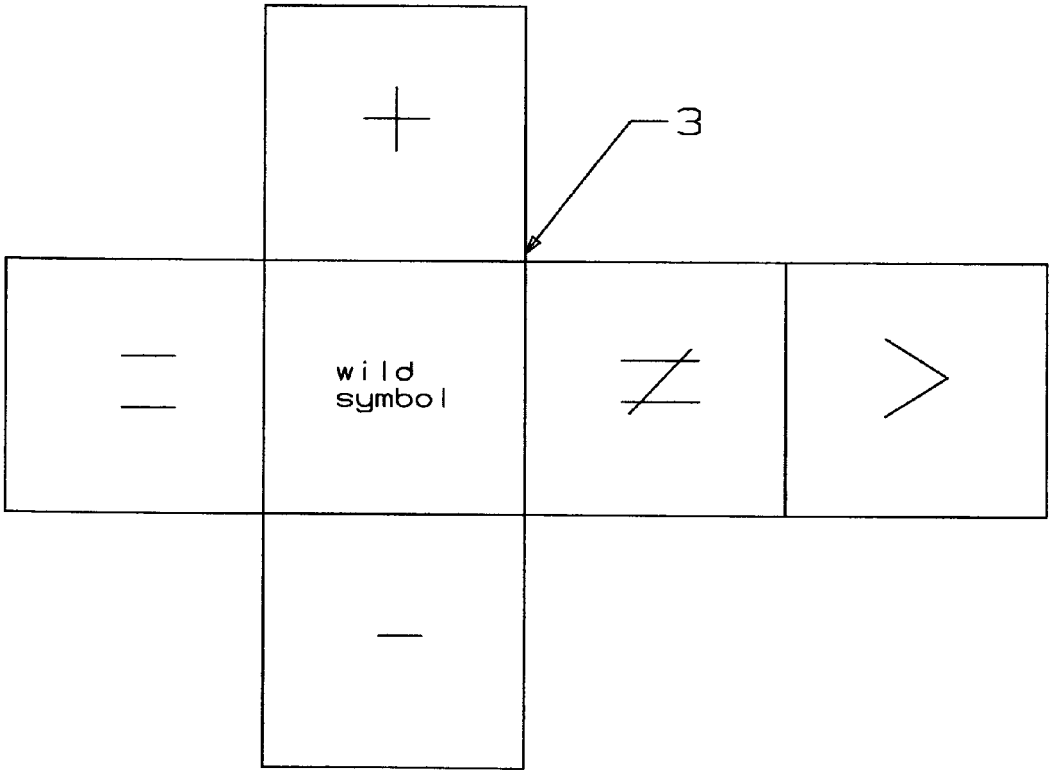
FIG. 5 depicts in an unfolded plan view, the symbols on the various facets of each of the equation blocks.
Figure 6:
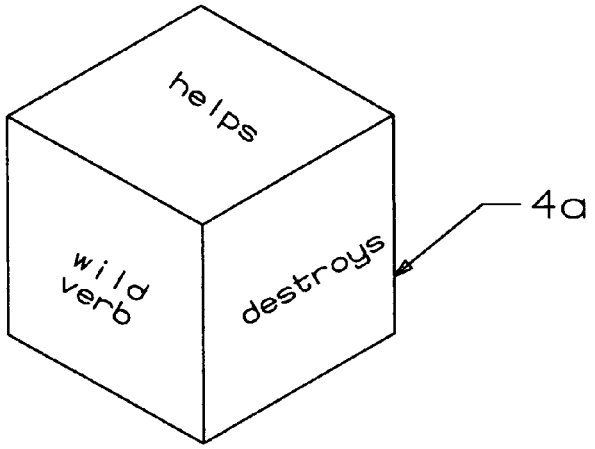
FIG. 6 is a perspective view of a first one of the three non-equivalent verb block components of the instant invention.
Figure 7:
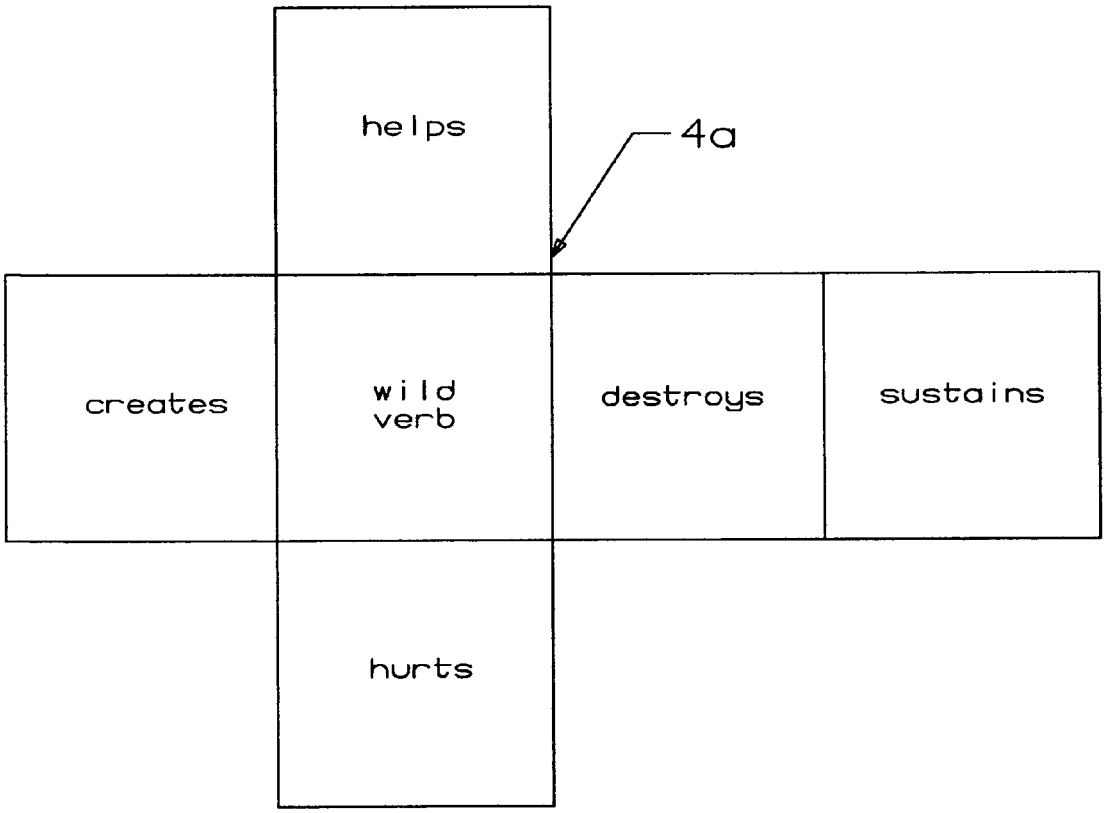
FIG. 7 depicts the words in an unfolded plan view on the various facets of the verb block shown in FIG. 6.
Figure 8:
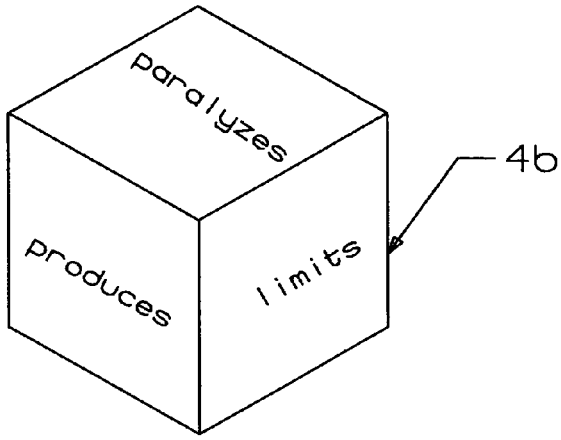
FIG. 8 is a perspective view of a second one of the three non-equivalent verb block components of the instant invention.
Figure 9:
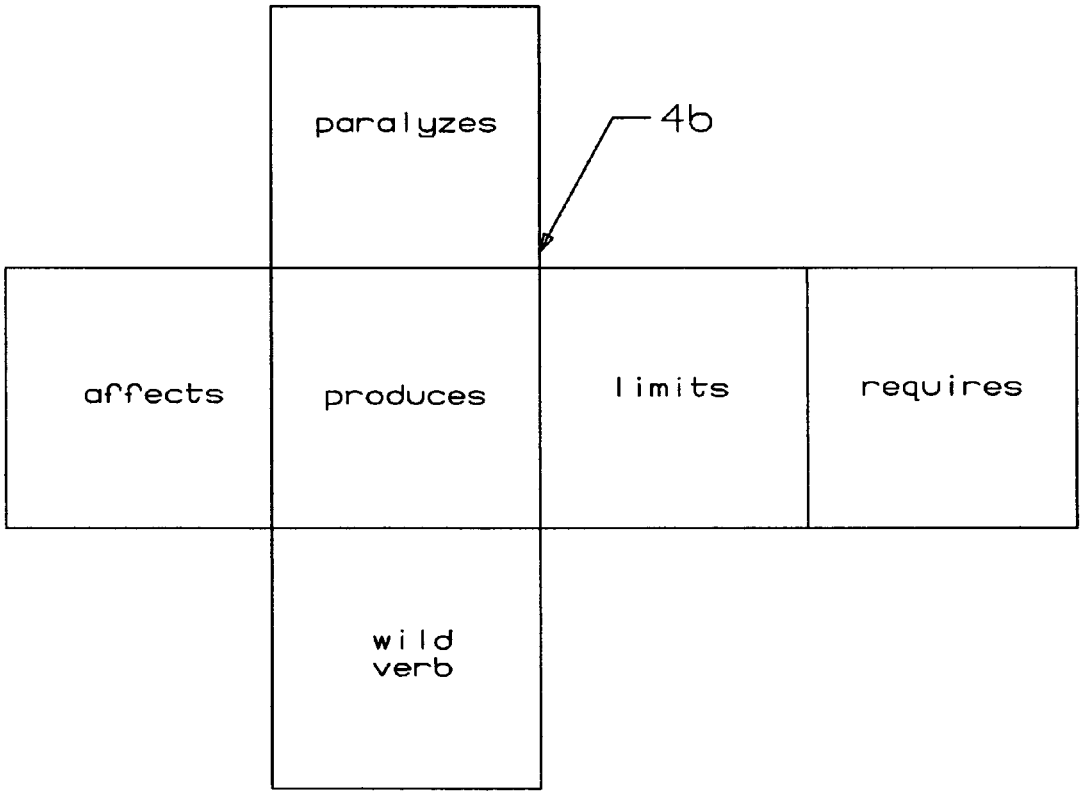
FIG. 9 depicts in an unfolded plan view, the words on the various facets of the verb block shown in FIG. 8.
Figure 10:
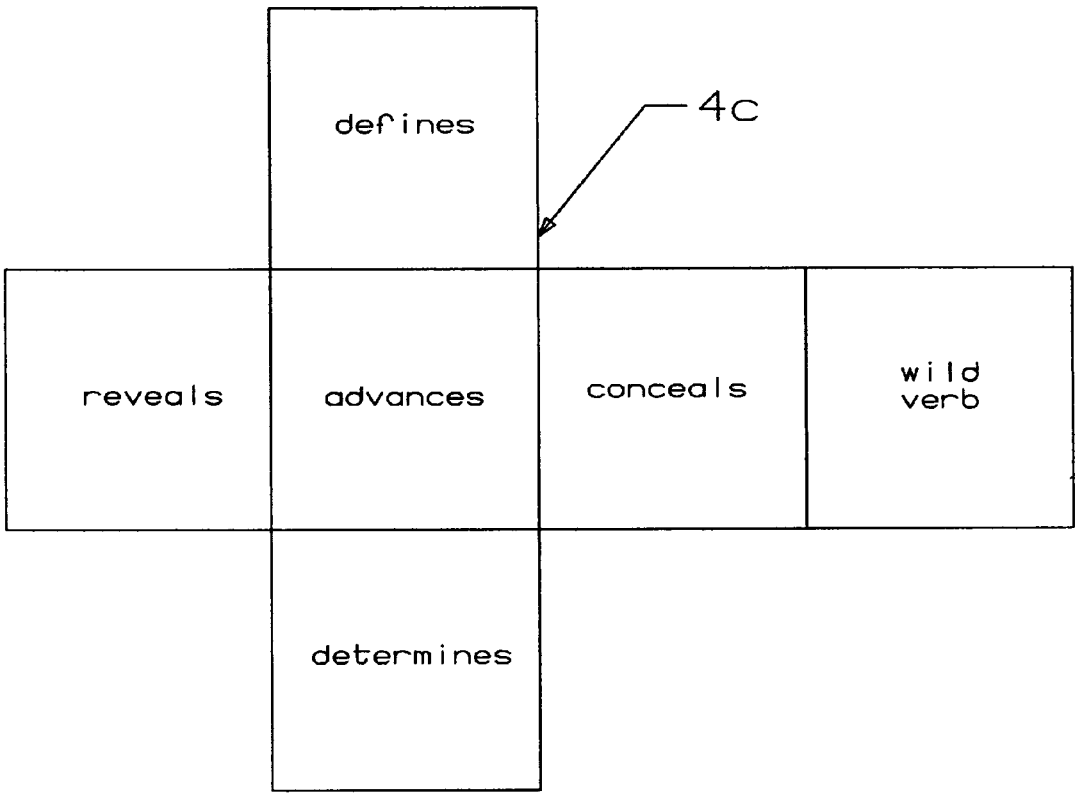
FIG. 10 depicts in an unfolded plan view the words on the various facets of the third verb block component of the instant invention.
Figure 11:
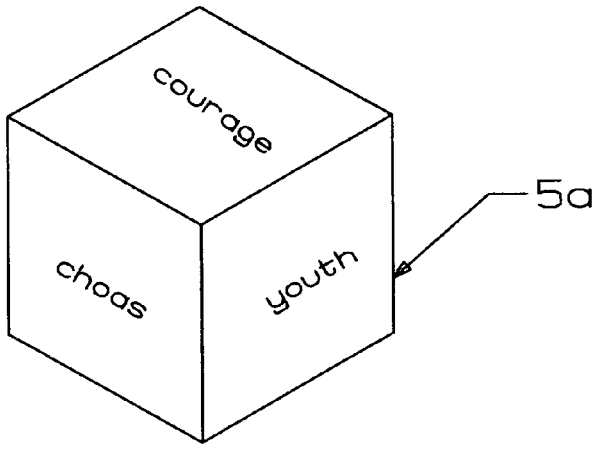
FIG. 11 is a perspective view of a first one of the ten non-equivalent noun blocks of the instant invention.
Figure 12:
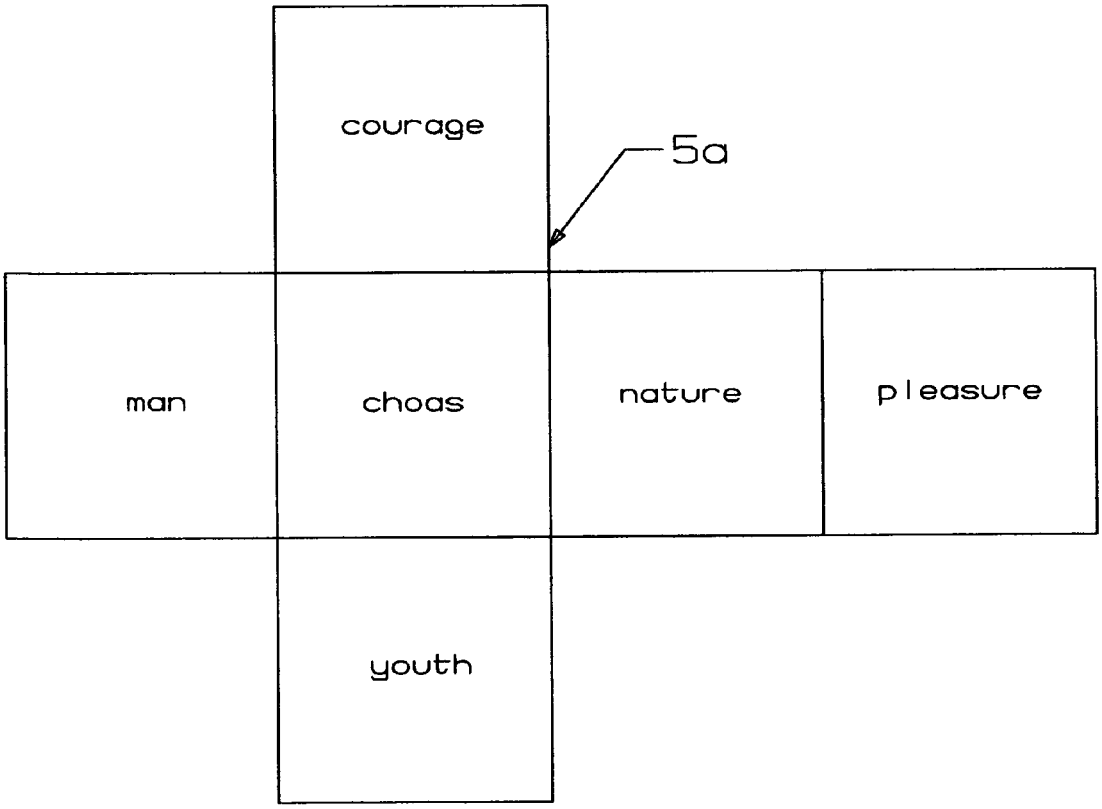
FIG. 12 depicts in an unfolded plan view, the words shown on the various facets of the noun block shown in FIG. 11.
Figure 13:
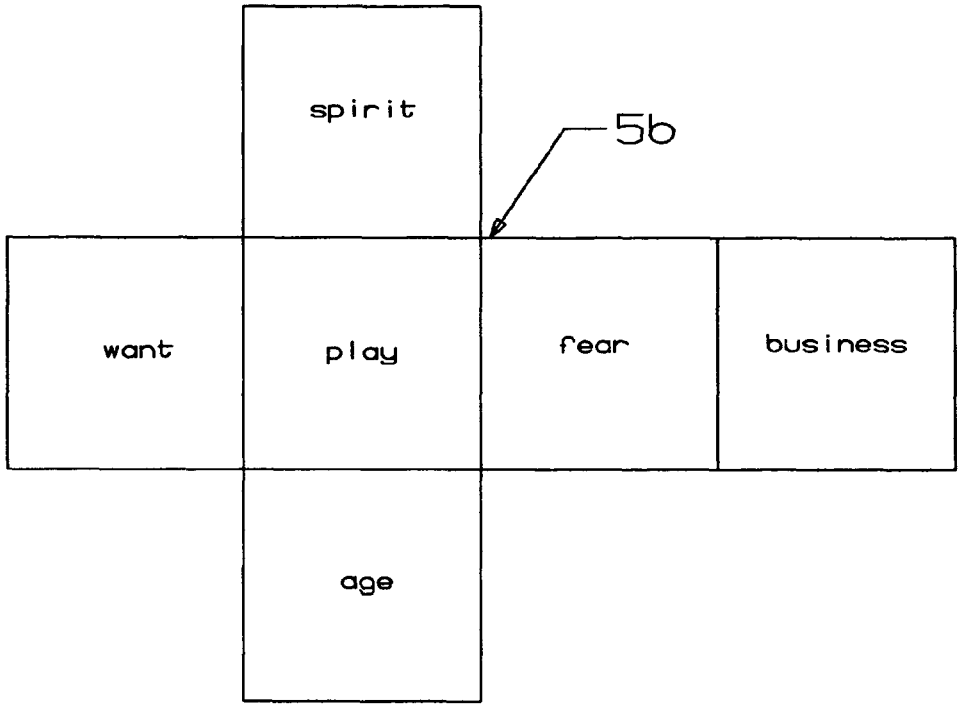
FIG. 13 depicts in an unfolded plan view, the words on the various facets of a second noun block of the instant invention.
Figure 14:
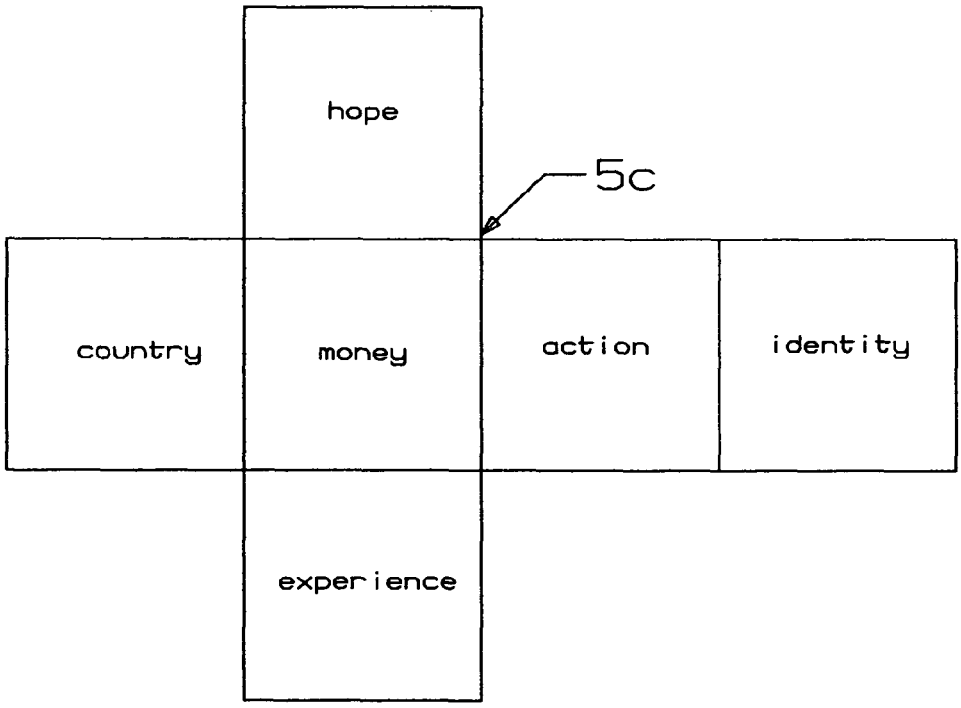
FIG. 14 depicts in an unfolded plan view, the words on the various facets of a third noun block of the instant invention.
Figure 15:
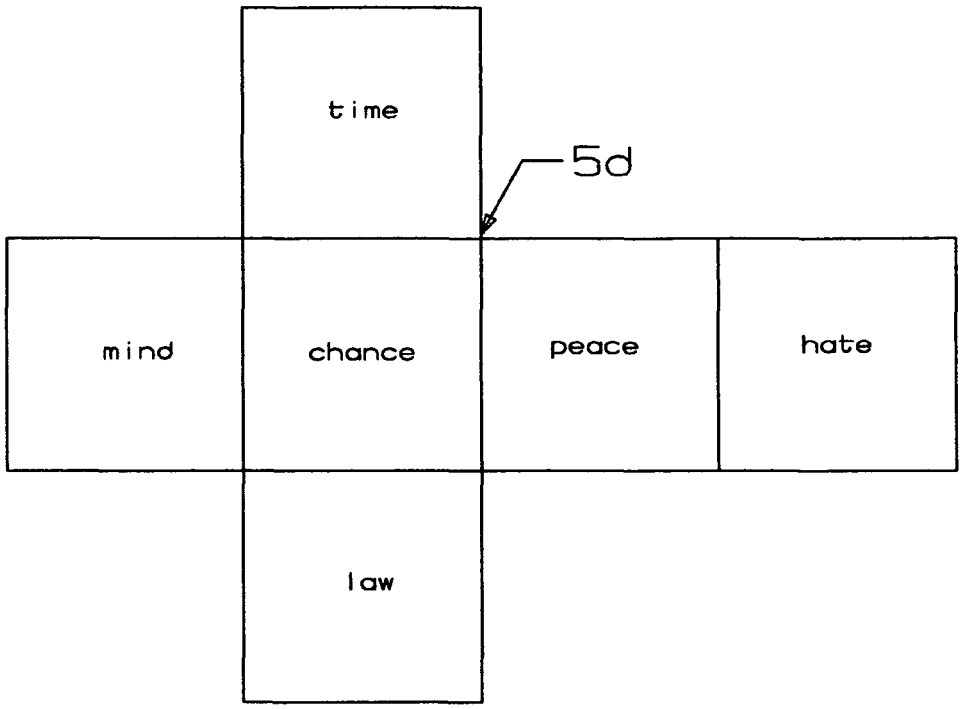
FIG. 15 depicts in an unfolded plan view, the words on the various facets of a fourth noun block of the instant invention.
Figure 16:
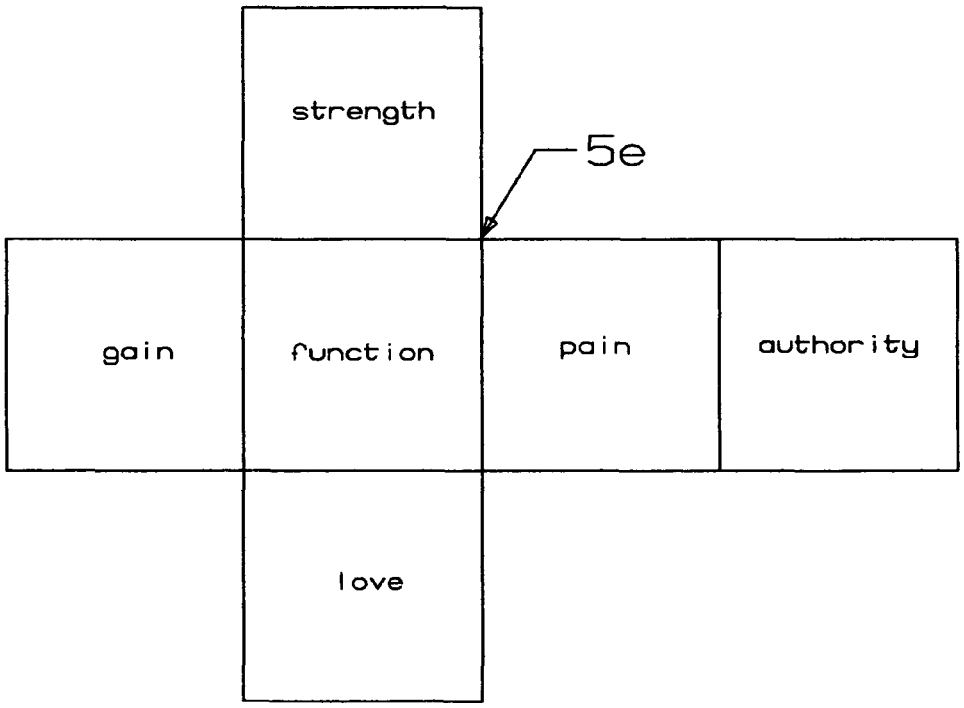
FIG. 16 depicts in an unfolded plan view, the words on the various facets of a fifth noun block of the instant invention.
Figure 17:
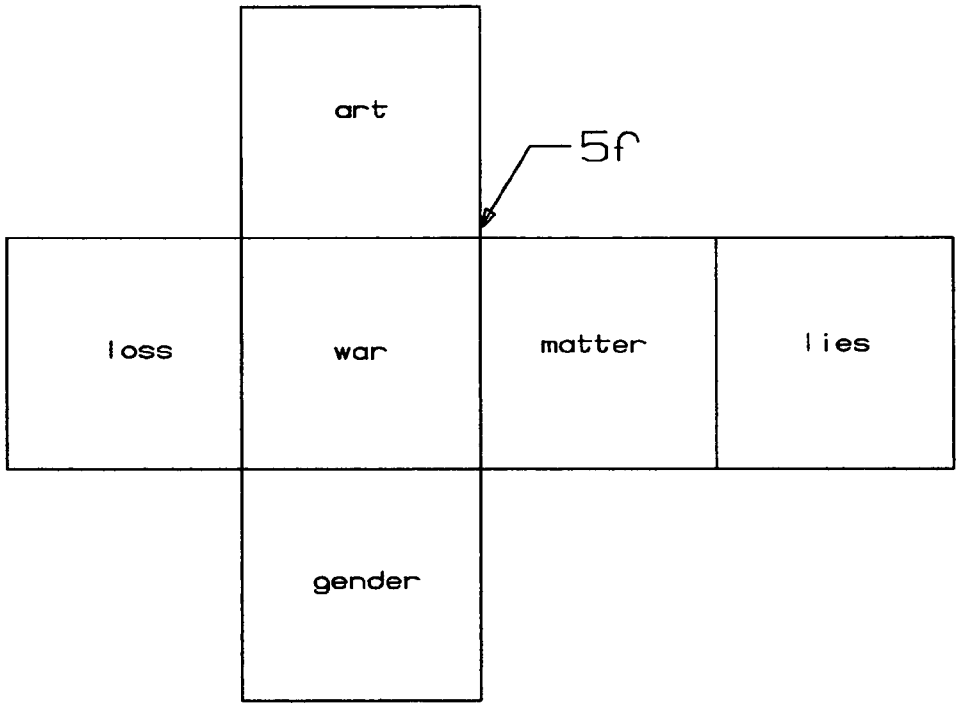
FIG. 17 depicts in an unfolded plan view, the words on the various facets of a sixth noun block of the instant invention.
Figure 18:
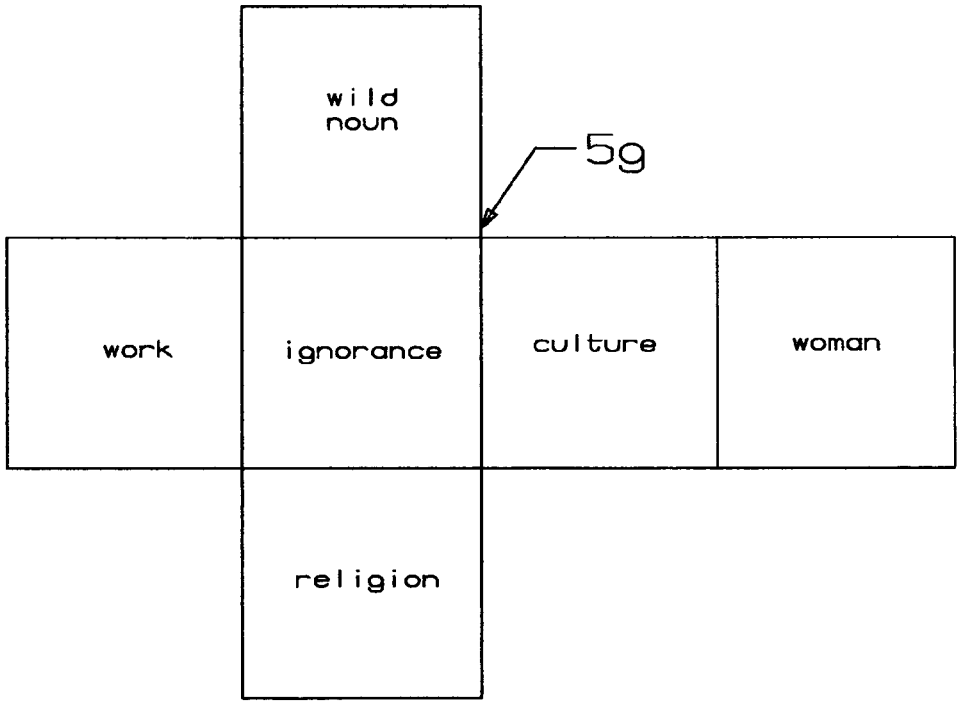
FIG. 18 depicts in an unfolded plan view, the words on the various facets of a seventh noun block of the instant invention.
Figure 19:
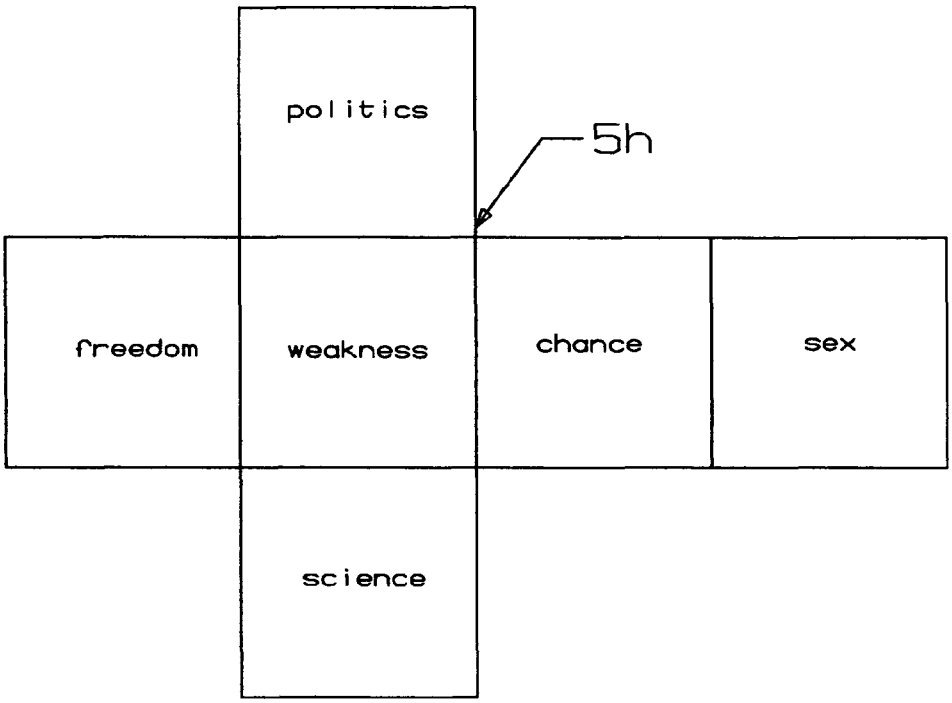
FIG. 19 depicts in an unfolded plan view, the words on the various facets of an eighth noun block of the instant invention.
Figure 20:
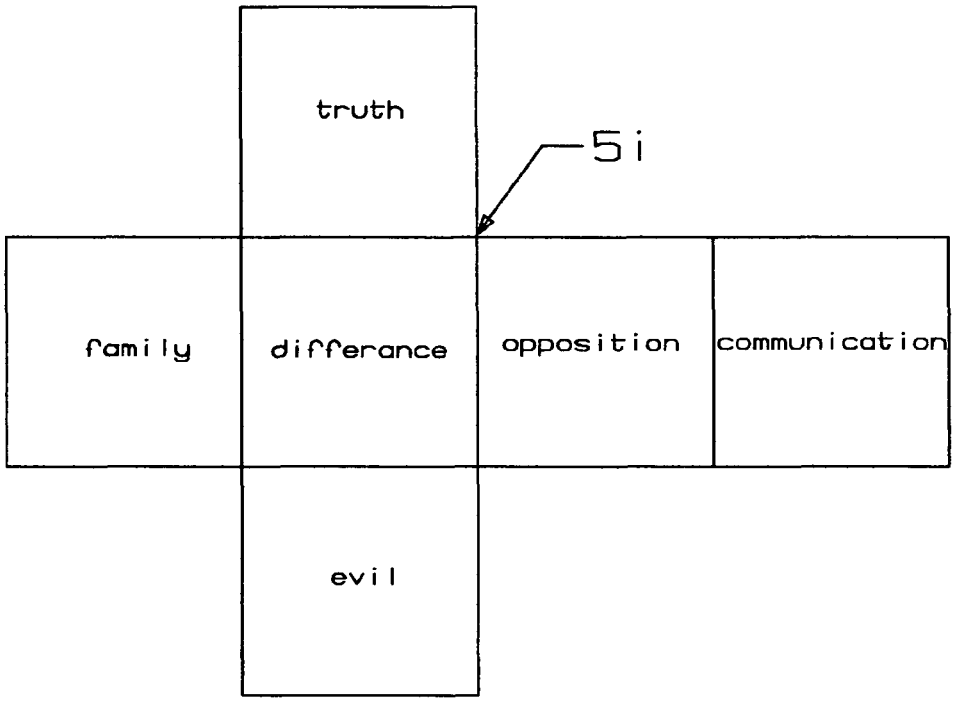
FIG. 20 depicts in an unfolded plan view, the words on the various facets of a ninth noun block of the instant invention.
Figure 21:
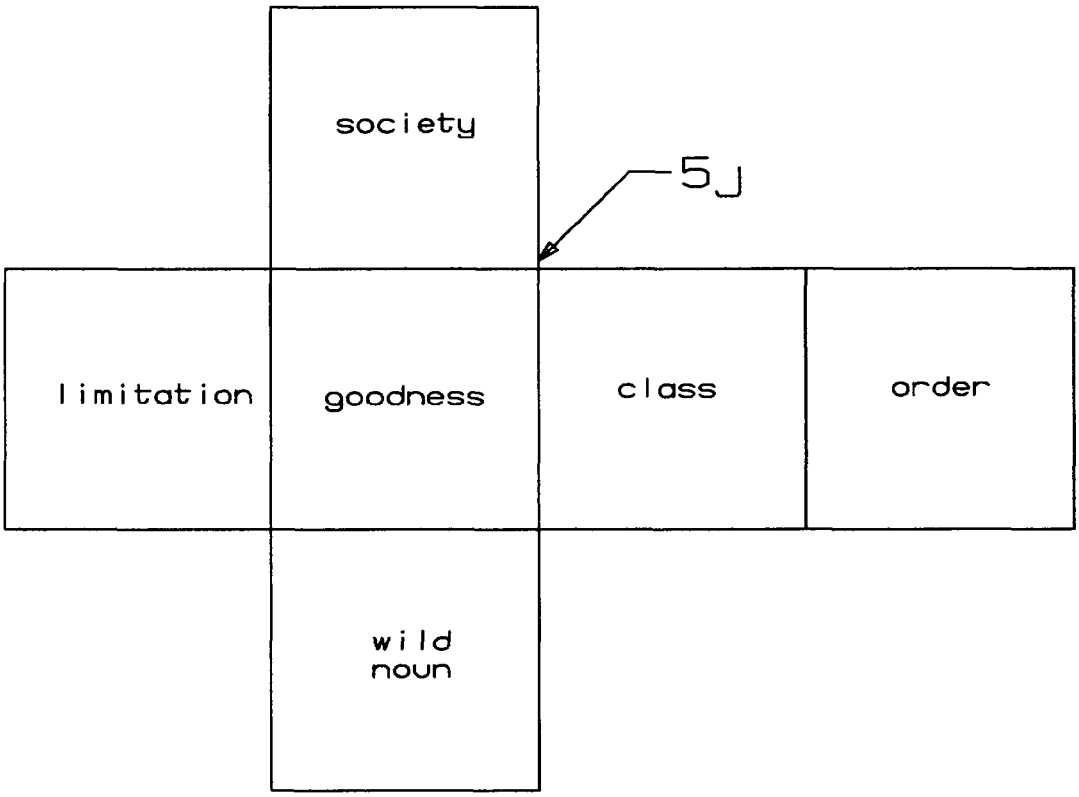
FIG. 21 depicts in an unfolded plan view, the words on the various facets of a tenth noun block of the instant invention.
Figure 33:
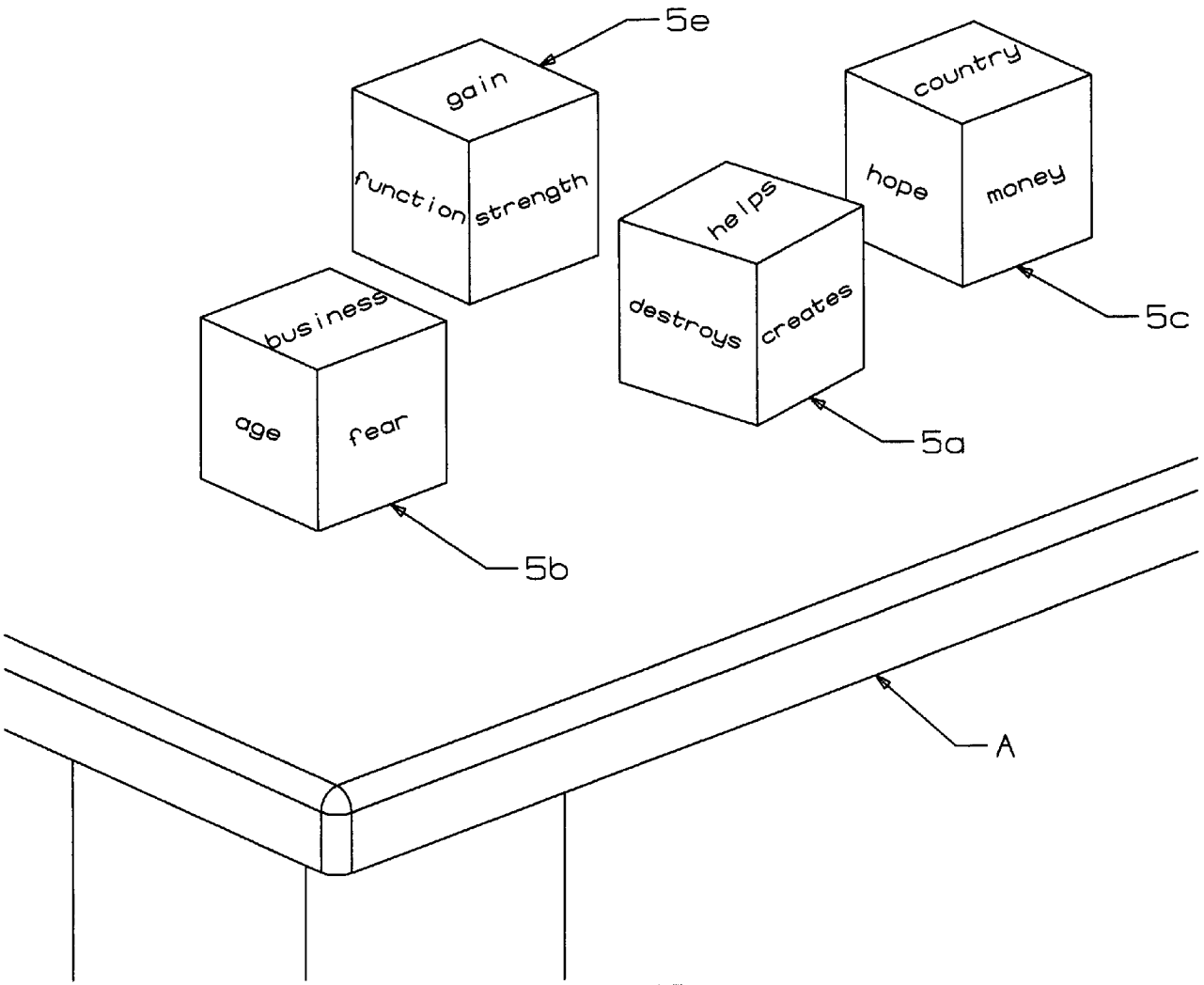
FIG. 33 illustrates in perspective view some just tossed block components with up faces depicting words to be utilized in forming a statement.

Anywhere from two to ten players may play the game each individually. An even number of players is desirable for purposes of playing within the basic or intermediate game formats. An odd number is suggested as respects the advanced format. The game is one involving initially the composition of a statement consisting at least three of the words depicted on the face-up facets of blocks rolled onto a floor or a table after having been shaken within and then spilled out of a tossing bag component 1 as depicted in FIG. 1. Such composition is undertaken by the persons having just shaken tossing bag component 1 filled with blocks. This person is designated as an author. Blocks having been shaken and then spilled out of a bag 1 and landing on, for example, a tabletop A as illustrated in FIG. 33 are then utilized by the author to compose a statement. The statement is then refined by the author. Refining connotes the utilization of no less than three or more of the words on the face-up facets of, for example, verb block 4*a* and noun blocks 5*b*, 5*c* and 5*e* as can be seen after tossing in FIG. 33 to formulate a proposition therefrom in the form of a complete sentence such as, for instance, "Business gain helps a country". Resort to utilization of pluralization of the words to be relied upon along with prepositions as well as definite or indefinite articles is permitted in respect of such sentence formulation. A supportive argument in justification of the merits of the refined statement is then proffered by the author. An illustration of what might constitute such an argument within the context of the foregoing stated example might be, for instance, business gains being a boon to the economy of a country, invariably helps that country to prosper. If the argument is accepted by a majority of the other players, the author is awarded points based upon the number of blocks utilized by the author to compose the initial statement. If the argument, on the other hand, is challenged, then the argument is defended by the author. An illustration of such a defense might be, in this instance, the recitation of the assertion that as business profits go up, money is spent by the owners to provide economic impetus to others who would not otherwise be so enabled to prosper. If the defense is then accepted by a majority of the other players, the author gets the points awardable with scoring as will be noted below. If the defense is not accepted by a majority of the other players, then the author gets no points. The tossing bag 1 is then again filled with blocks and a next player in the group becomes the author deigned to proceed as did the previous player in an effort to be ultimately awarded points. Each player; in an effort to secure points based upon a tossing of blocks, a composition of a statement therefrom, a refining thereof, and an argument in support of the same and perhaps yet more argument in defense of the same; is typically given two minutes to compose such a statement and, then typically more three minutes to refine and it and then derive a supportive, and, if need be, further defensive argument hopefully amenable to ultimate acceptance by a majority of the other opposing players. The game in either or all of the three: basic, intermediate or advanced formats typically consists of up to four predetermined rounds of play per format with each round involving the granting of an opportunity to each player to be an author in that round. After completion of all predetermined rounds of play in the basic format only, the player with the most points accumulated in all of the rounds is designated as the winner of the game. If, after all of the rounds in the basic format are played, it is the wish of the players to proceed to the intermediate format, then after four rounds thereof, the player with the most awarded points in all rounds is designated the winner. Correlatively, if it is decided to, after all such rounds to then proceed to the advanced format, then the player with the most points after the then twelve rounds of play is deemed to be the ultimate winner. There are up to ten non-equivalent noun blocks 5*a* through 5*j* to be noted with resort to FIGS. 11 through 21 inclusive respectively, two equivalent equation blocks 3 seen with resort to FIGS. 4 and 5, three non-equivalent verb blocks 4*a*, 4*b* and 4*c* to be noted with resort to FIGS. 6 through 10 inclusively, and one frequency block 2 noted with reference to FIGS. 2 and 3 available for use in the game depending upon the game format sought to be played and the rounds then being played therein. It will be further noted with reference to FIGS. 11 through 21 that each of the non-equivalent noun blocks 5*a* through 5*j* is distinctive, one from the other in that; except for the presence on each of the noun blocks, 5*g* and 5*j* depicted in FIGS. 18 and 21 of a non-worded wild noun facet; no distinct noun word per worded facet of any noun block, 5*a*-5*j* inclusive appears on any worded facet of any other noun block. It will be moreover noted with reference to FIGS. 6 through 10 that each non-equivalent verb block is also distinctive, one from the other in that no distinct verb word per worded facet of any one verb block 4*a*, 4*b*. or 4*c*. appears on any worded facet of any other verb block except for the presence on each of a non-worded wild verb facet. It should be noted, at this juncture, that it might be decided in advance by the players that less than four rounds per format might be played and/or that less than all three formats would be resorted to from commencement to completion of the same.

Figure 32:
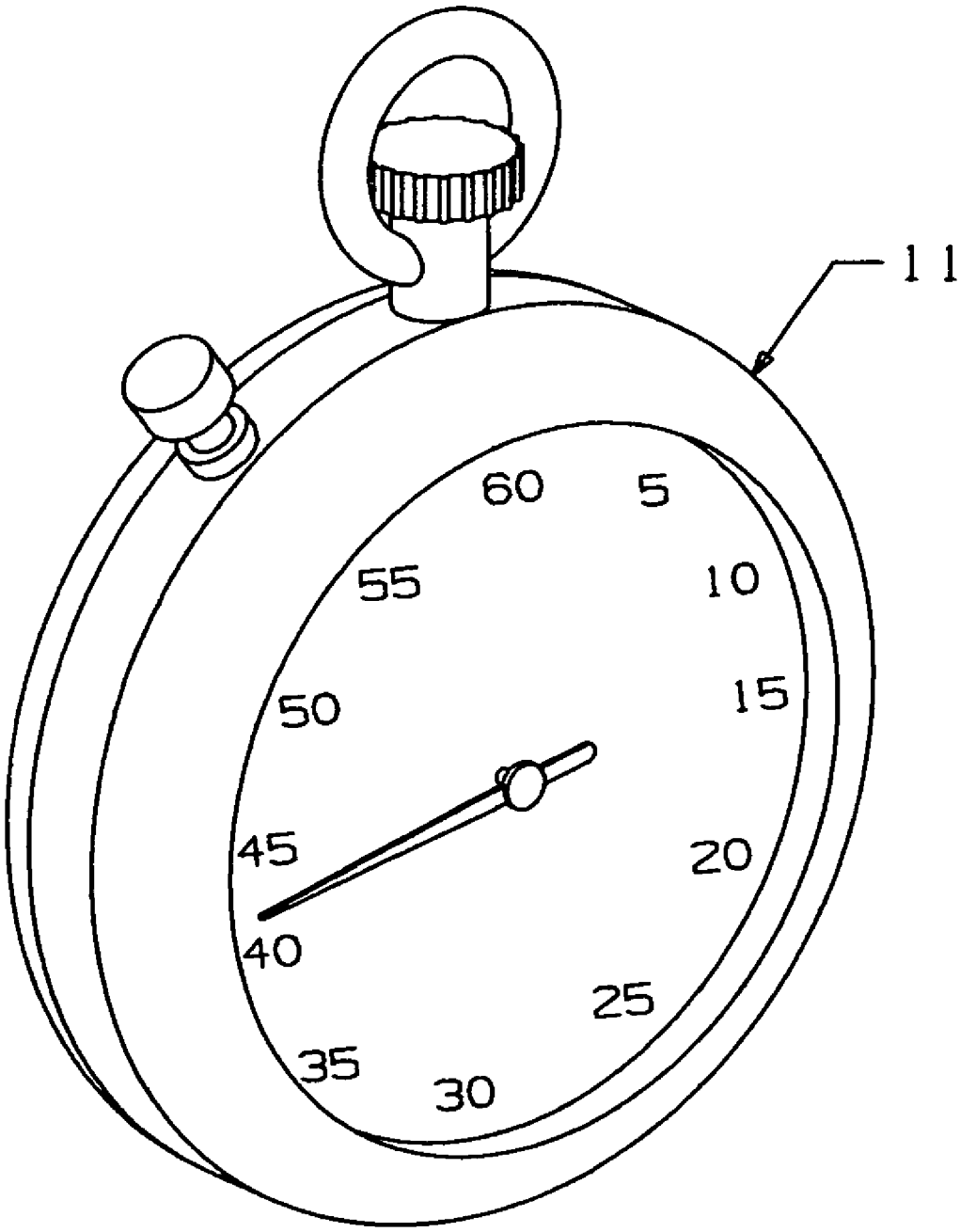
FIG. 32 is a perspective view of a stopwatch component of the instant invention.

As regards the basic format, the following provisos apply. Tossing bag component 1 is, for round one thereof, filled with any seven of the ten noun blocks numbered 5*a* through 5*j* along with one of the verb blocks 4*a*, 4*b* or 4*c*. Each player, upon commencement of the game maybe optionally supplied with one of up to ten equivalent affirmative ballot cards 8 depicted in FIGS. 26 and 27 each with the word, ballot imprinted on the top side thereof and each with the word, yes imprinted on the bottom side thereof and with one of the ten equivalent negative ballot cards 7 as depicted in FIGS. 24 and 25 each with the word, ballot imprinted on the top side thereof and each with the word, yes imprinted on the bottom side thereof. These are laid face down by each player in front of him or her. A timing device such as the stopwatch 11 seen in FIG. 32 is likewise utilized by the players. Upon completion of round one and at the beginning of round two, two additional noun blocks among the remaining ones of blocks 5*a* through 5*j* and one additional verb block among the remaining two of blocks 4*a*, 4*b* and 4*c* are placed into tossing bag component 1 for use by the players. The third round is played by way of an adding of the two equivalent equation blocks 3 to be shaken within and then tossed out of tossing bag component 1 by each player in that round then acting as an author. The fourth round involves the adding of yet another noun block among the remaining ones of blocks 5*a* through 5*j* and yet another verb block, to wit, the remaining one of blocks 4*a*, 4*b* and 4*c* to be so shaken and tossed respectively by each player within that final round. Acceptance or rejection of an author's argument in support thereof, is reflected by either a majority voice vote or, a majority vote as reflected, by a turning over, by each of the opposing players, of either an optionally provided affirmative ballot card 8 from the top side to the bottom side thereof or an optionally provided negative ballot card 7 from the top side to the bottom side thereof, all upon completion of the argument by the author within the previously agreed-to time allotted for completion of the same.

Within the framework of all three formats of the game, once again, any statement composed by an author after having spilled out blocks may be made up of words appearing on the face-up facets of either some or indeed all of the blocks. One point is awarded to the author after ultimate acceptance of the author's argument by a majority of the other players for each word in any three word statement, and two points per word are awarded for each word utilized in any four or more word statement as would have been deemed to have been successfully and timely argued for by an author in the minds eyes of a majority of the opposing players. But, once again, no would-be statement consisting of less than three words may be utilized as any predicate for a refining thereof and then subsequent argument regarding the same. Prepositions and definite or indefinite articles as noted previously may be utilized to refine a composed statement, but any such prepositions or articles so used are not countable for purposes of an author's being awarded points. Every refined statement must include at least one face up verb block 4*a*, 4*b* or 4*c* or a face up symbol from at least one equivalent equation block 3 when utilized during any tossing event. Each greater than and each less than symbol on each equivalent equation block 3 may be used in composing a statement either as "greater than" or "less than" after having been initially spilled out face up by an author-player. The equal and unequal signs found upon the facets of an equation block 3 can stand for, for example, "the same as" or "different than" respectively in the composition of a statement. The plus and negative signs thereupon can connote, for example, "together with" or "without" respectively in the composition of a statement. The "wild" facet if found face up after a roll can be utilized as being any one of the other five symbols on the block for such purpose as well. The "wild" facets on noun block numbered 5*g* or 5*j* or verb block 4*a*, 4*b* or 4*c* can be utilized as being any one of the other five symbols on the block on which they are to be found in the event one or more of them are rolled face up upon completion of a toss.

Figure 2:
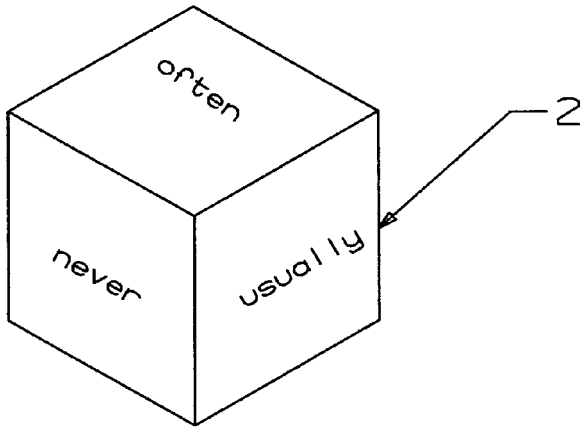
FIG. 2 is a perspective view of the frequency block component of the instant invention.
Figure 3:
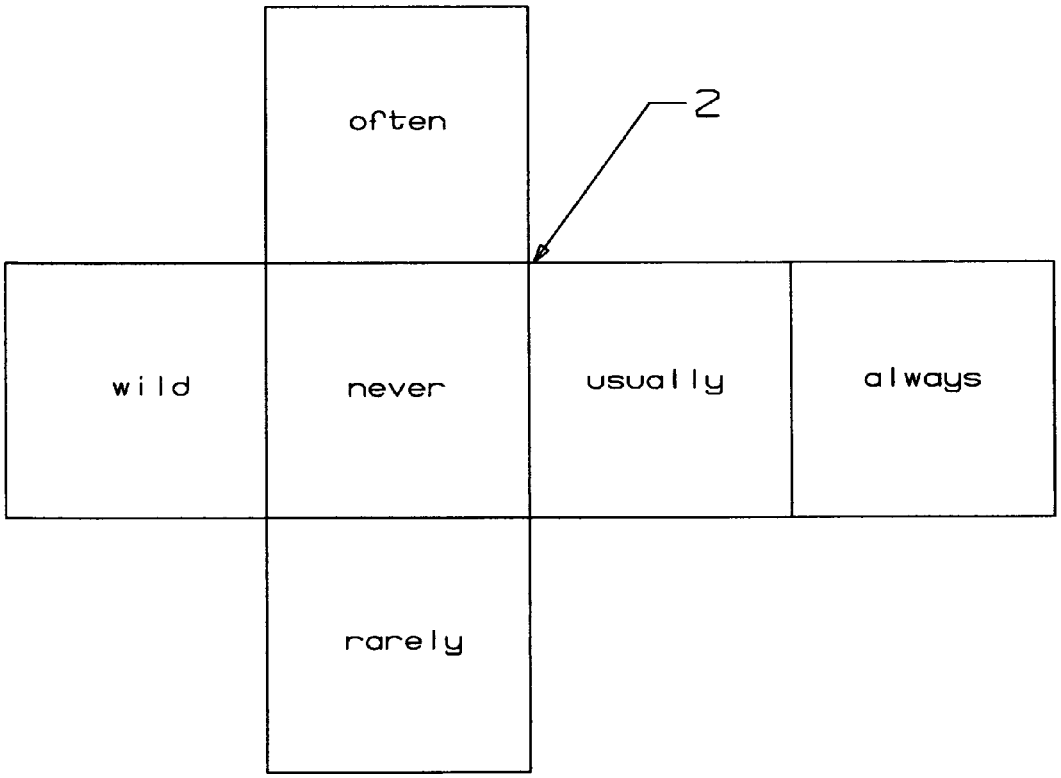
FIG. 3 depicts in an unfolded plan view the words on the various facets of the frequency block.

The intermediate format differs from the basic format insomuch as the intermediate format involves resort to the specialized utilization by each of the players of one of up to ten equivalent challenge cards 6 as depicted in FIGS. 22 and 23 with the word eligible imprinted on the top side of each and the word, out imprinted on the bottom side of each, as well as resort to now a debate format. One player is assigned the task of serving as a moderator of the debate. The protocols established in the basic format are endemic to this format as well, except that with respect to this format, once a non-author elects to become a challenger, to wit, challenging acceptor and issue a challenge to an argument in support of a refined statement as evidenced by that non-author's turning his or her challenger card 6 over from the "eligible" side as seen in FIG. 22 to the "out" side as seen in FIG. 23, all pursuant to an invitation extended by the moderator to do so with the moderator extending such invitations to each non-author to challenge or not by moving counter clockwise with invitations starting from the player to the right of the author, then that challenging acceptor, in respect of such specialized utilization may no longer thereafter issue a challenge for the balance of that round in that format. Moreover, once such a challenge accordingly issues, the debating ensues. The challenging acceptor provides an argument in opposition to the author's argument, not defended in this format, and the author is then given an opportunity to rebut such opposition. Such rebuttal is followed by the challenging acceptor's one minute closing argument followed by a vote by all players except the author as respects whether the author has prevailed so as to then be awarded points. A challenging acceptor may cede his or her opportunity to close upon request from another player to do so, but if such other player makes the closing, that player's right to challenge later in the round is forfeited. If there are no challengers left in the round to oppose an author's argument, then the author is automatically awarded points tabulated just as with respect to the tabulation protocol established as regards the basic format except as respects the matter of resort to, in this format, utilization of the frequency block 2 as depicted in FIGS. 2 and 3. The frequency block 2 is utilized in this format. Frequency block 2 has different adverbs on five of the six facets thereof and the word, "wild" on one facet thereof as will be noted with reference to FIGS. 2 and 3. If the "wild" facet is tossed face up, then, use may be made of any adverb from any one of the other facets thereof for purpose of composing a statement within the aegis of this format. An author successfully arguing in support of a statement predicated upon resort to a face-up symbol on a frequency block is awarded an additional five points for the argument. If on the other hand, subsequent to a challenge and debate as noted above, the author does not secure a majority of votes in his or her favor, then, the challenging acceptor is awarded the five points only. This is the only instance within the framework of the format wherein a challenging acceptor might acquire points if an author fails to acquire any for lack of a majority vote in his or her favor following the end of debate during that author's turn.

The advanced format incorporates all of the features of the intermediate format. However, in this format, optional opponent ballot cards 9 as depicted in FIGS. 28 and 29 and optional author ballot cards 10 as depicted in FIGS. 30 and 31 are utilized. These cards are utilized for the purpose of tallying votes at the end of a debate. In the advanced format, if the author does not prevail by a majority, per a vote tally wherein neither the author nor the challenging acceptor may vote, then, the challenging acceptor is awarded all of the points that would have otherwise been awarded to the author. Moreover, in this format, there is no opportunity afforded to any second would-be challenging acceptor to make a closing argument for a first challenger. In this format, a turning over of an opponent ballot card 9, a topside of which is shown in FIG. 28 so as to show the bottomside of that card as shown in FIG. 29 signifies a player's post-debate vote for a challenger and conversely, a turning over instead of an author ballot card 10, the topside of which is seen in FIG. 30 so as to thereby show the bottomside of that card as seen in FIG. 31 signifies a player's post-debate vote for the author.

The game can be played with up to four rounds of play as specified above in either the basic or intermediate or advanced formats of play. Alternative, it could be played with up to four rounds of play as specified above per format in first the basic format and then the intermediate or advanced format. Or, it could be played for up to four rounds of play as specified above per format in only the intermediate and then advanced format. Or finally it could be played for up to four rounds of play as specified above per format for all three formats of play.

In conclusion, it is respectfully submitted that the instant game of defending statements with persuasive arguments is not only new but indeed useful from the vantage point of providing a source of true relaxation to people within a group setting. Finally, as well, it is likewise truly unique as a means for promoting intellectual stimulation as well as being truly a viable resource for facilitating on-the-spot learning.

What is claimed is:

1. A game apparatus consisting of:

a. ten non-equivalent noun blocks;

b. three non-equivalent verb blocks;

c. two equivalent equation blocks;

d. a tossing bag;

e. two of said noun blocks having one distinct noun word imprinted on each one of five worded noun block facets of each of said two of said noun blocks with each one of said each of said two of said noun blocks having one non-worded wild noun facet with the words, "wild noun" imprinted thereon;

f. said non-worded wild noun facet on said each one of said two of said noun blocks serving to designate any other one of said noun words imprinted on any other one of said five noun block facets on said each one of said two of said noun blocks;

g. eight of said noun blocks having one of said noun words imprinted on each of six worded noun block facets thereof;

h. no one of said noun words being equivalent to any other one of said noun words;

i. one of said verb blocks having one distinct verb word imprinted on each one of five verb block worded facets thereof and having one non-worded wild verb facet with the words, "wild verb" imprinted thereon;

j. said non-worded wild verb facet serving to designate any other one of said verb words imprinted on said one of said verb blocks;

k. two of said verb blocks having one said verb word imprinted on each of six worded verb block facets thereof;

l. no one of said verb words being equivalent to any other one of said verb words;

m. each said equivalent equation block having imprinted on said each equation block facet thereof respectively, one of each of the following symbols per said each equation block facet, to wit: a greater than and less than sign, a plus sign, a minus sign, an equals sign, an unequals sign, and the words, to wit, wild symbol and further providing said words, wild symbol as being meant to serve as being equatable with any other one of said signs;

n. said tossing bag serving at any initial time to hold within it, a plurality of said noun blocks and one of said verb blocks for purposes of tossing all of said so held blocks onto a flat, rigid surface in anticipation of the composition of a statement refined into a complete sentence supported by challengeable argument from the ones of said noun words and said verb word appearing on any of said noun block facets and any said verb block facet facing upwardly after such tossing;

o. said tossing bag serving at any later time to hold within it, a plurality of said noun blocks and a plurality of said verb blocks for purposes of tossing all of said so held blocks onto a flat, rigid surface in anticipation of the composition of a statement refined into a complete sentence supported by challengeable argument from the ones of said noun words and said verb words appearing on such of said noun block facets and said verb block facets facing upwardly after such tossing;

p. said tossing bag serving at any further later time to hold within it, a plurality of said noun blocks, a plurality of said verb blocks and said equation blocks for purposes of tossing all of said so held blocks onto a flat, rigid surface in anticipation of the composition of a statement refined into a complete sentence supported by a challengeable argument from the ones of said noun words, said verb words and said equation block symbols appearing on such of said noun block facets, said verb block facets and said equation block facets facing upwardly after such tossing;

q. said greater than and less than sign serving to permit resort to comparative quantification, to wit: "greater than" or "less than" in respect of said composition of a statement refined into a complete sentence supported by a challengeable argument;

r. said equals sign serving to permit resort to a notion of equivalence, to wit: "the same as" in respect of said composition of a statement refined into a complete sentence supported by a challengeable argument;

s. said unequal sign serving to permit resort to a notion of non-equivalence, to with: "different than" in respect of said composition of a statement refined into a complete sentence supported by a challengeable argument;

t. said plus sign serving to permit resort to a notion of aggregation, to wit: "together with" in respect of said composition of a statement refined into a complete sentence supported by a challengeable argument;

u. said minus sign serving to permit resort to a notion of non-aggregation, to wit: "without" in respect of said composition of a statement refined into a complete sentence supported by a challengeable argument;

v. said words, wild symbol serving to permit resort to any other one of said signs in respect of said composition of a statement refined into a complete sentence supported by a challengeable argument;

w. a stopwatch, and;

x. said stopwatch serving to facilitate adherence to a time limit in respect of any player person's composition of a statement refined into a complete sentence supported by a challengeable argument.

2. A game apparatus consisting of:

a. ten non-equivalent noun blocks;

b. three non-equivalent verb blocks;

c. two equivalent equation blocks;

d. a frequency block;

e. a tossing bag;

f. two of said noun blocks having one distinct noun word imprinted on each one of five worded noun block facets of each of said two of said noun blocks with each one of said each of said two of said noun blocks having one non-worded wild noun facet with the words, "wild noun" imprinted thereon;

g. said non-worded wild noun facet on said each one of said two of said noun blocks serving to designate any other one of said noun words imprinted on any other one of said five noun block facets on said each one of said two of said noun blocks;

h. eight of said noun blocks having one of said noun words imprinted on each of six worded noun block facets thereof;

i. no one of said noun words being equivalent to any other one of said noun words;

j. one of said verb blocks having one distinct verb word imprinted on each one of five verb block worded facets thereof and having one non-worded wild verb facet with the words, "wild verb" imprinted thereon;

k. said non-worded wild verb facet serving to designate any other one of said verb words imprinted on said one of said verb blocks;

l. two of said verb blocks having one said verb word imprinted on each of six verb block facets thereof;

m. no one of said verb words being equivalent to any other one of said verb words;

n. each said equivalent equation block having imprinted on said each equation block facet thereof respectively, one of each of the following symbols per said each equation block facet, to wit: a greater than and less than sign, a plus sign, a minus sign, an equals sign, an unequals sign, and the words, to wit, wild symbol and further providing said words, wild symbol as being meant to serve as being equatable with any other one of said signs;

o. said frequency block having one distinct adverb word on each one of five frequency block facets thereof and having one blank frequency block facet with one word, to wit, "wild" imprinted thereupon;

p. said word, "wild" serving to designate any one of said adverb words;

q. said tossing bag serving at any initial time to hold within it, a plurality of said noun blocks and one of said verb blocks for purposes of tossing all of said so held blocks onto a flat, rigid surface in anticipation of the composition of a statement refined into a complete sentence supported by challengeable argument from the ones of said noun words and said verb words appearing on such of said noun block facets and said verb block facets facing upwardly after such tossing;

r. said tossing bag serving at any later time to hold within it, a plurality of said noun blocks and a plurality of said verb blocks for purposes of tossing all of said so held blocks onto a flat, rigid surface in anticipation of the composition of a statement refined into a complete sentence supported by challengeable argument from the ones of said noun words and said verb words appearing on such of said noun block facets and said verb block facets facing upwardly after such tossing;

s. said tossing bag serving at any further later time to hold within it, a plurality of said noun blocks, a plurality of said verb blocks and said equation blocks for purposes of tossing all of said so held blocks onto a flat, rigid surface in anticipation of the composition of a statement refined into a complete sentence supported by a challengeable argument from the ones of said noun words, said verb words and said equation block symbols appearing on such of said noun block facets, said verb block facets and said equation block facets facing upwardly after such tossing;

t. said tossing bag serving at any subsequently further later time to hold within it, a plurality of said noun blocks, a plurality of said verb blocks, said frequency block and said equation blocks for purposes of tossing all of said so held blocks onto a flat, rigid surface in anticipation of the composition of a statement refined into a complete sentence supported by a challengeable argument from the ones of said noun words, said verb words, said frequency block and said equation block symbols appearing on such of said noun block facets, said verb block facets, said frequency block facets and said equation block facets facing upwardly after such tossing;

u. said greater than and less than sign serving to permit resort to comparative quantification, to wit: "greater than" or "less than" in respect of said composition of a statement refined into a complete sentence supported by a challengeable argument;

v. said equals sign serving to permit resort to a notion of equivalence, to wit: "the same as" in respect of said composition of a statement refined into a complete sentence supported by a challengeable argument;

w. said unequal sign serving to permit resort to a notion of non-equivalence, to with: "different than" in respect of said composition of a statement refined into a complete sentence supported by a challengeable argument;

x. said plus sign serving to permit resort to a notion of aggregation, to wit: "together with" in respect of said composition of a statement refined into a complete sentence supported by a challengeable argument;

y. said minus sign serving to permit resort to a notion of non-aggregation, to wit: "without" in respect of said composition of a statement refined into a complete sentence supported by a challengeable argument;

z. said words, wild symbol serving to permit resort to any other one of said signs in respect of said composition of a statement refined into a complete sentence supported by a challengeable argument;

aa. a stopwatch, and;

bb. said stopwatch serving to facilitate adherence to a time limit in respect of any player person's composition of a statement refined into a complete sentence supported by a challengeable argument.

* * * * *